US007334686B2

(12) United States Patent
Filardi

(10) Patent No.: US 7,334,686 B2
(45) Date of Patent: Feb. 26, 2008

(54) GIFT BOX HAVING DROP DOWN SIDES

(75) Inventor: Natalie Filardi, 715 E. Redwood St., Hanford, CA (US) 93230

(73) Assignee: Natalie Filardi, La Plata, MD (US)

( * ) Notice: Subject to any disclaimer, the term of this patent is extended or adjusted under 35 U.S.C. 154(b) by 188 days.

(21) Appl. No.: 11/117,177

(22) Filed: Apr. 28, 2005

(65) Prior Publication Data

US 2006/0243639 A1 Nov. 2, 2006

(51) Int. Cl.

| | |
|---|---|
| ***B65D 5/00*** | (2006.01) |
| ***B65D 85/20*** | (2006.01) |
| ***B65D 25/34*** | (2006.01) |
| ***G09F 3/00*** | (2006.01) |

(52) U.S. Cl. ..... 206/766; 206/446; 206/805; 229/103; 229/116.5; 229/923; 40/312

(58) Field of Classification Search ..... 206/766, 206/769, 774, 805, 446, 523, 765; 229/108.1, 229/115, 116.5, 103; D9/421; 40/312–313
See application file for complete search history.

(56) References Cited

U.S. PATENT DOCUMENTS

| | | | | | |
|---|---|---|---|---|---|
| 1,072,399 | A | * | 9/1913 | Lyon | 206/805 |
| 1,361,318 | A | * | 12/1920 | Ephlin | 229/120.38 |
| 1,625,192 | A | * | 4/1927 | Cooper | 206/765 |
| 1,734,621 | A | * | 11/1929 | Goldberg | 206/766 |
| 2,207,567 | A | * | 7/1940 | Warner | 229/116.5 |
| D153,797 | S | * | 5/1949 | Heim | 206/766 |
| D155,246 | S | * | 9/1949 | Von Miklos | D9/421 |
| 2,776,083 | A | * | 1/1957 | Derman | 206/766 |
| 2,808,194 | A | * | 10/1957 | Dols | 229/116.5 |
| 3,542,282 | A | * | 11/1970 | Troth | 206/523 |
| 4,614,266 | A | * | 9/1986 | Moorhead | 40/312 |
| D330,853 | S | * | 11/1992 | Koytuk | D9/421 |

* cited by examiner

*Primary Examiner*—Bryon P. Gehman

(57) ABSTRACT

A box includes a bottom, a plurality of collapsible sides affixed to the bottom, and a lid for holding them in place. A support structure provided for the box includes sides that drop away from the center where an item or gift is stored. The bottom and sides are typically formed from a single piece of support material that may be scored where the side and bottom meet. This thickness of the scored area is thinner than that of the sides and bottom. This operates to allow the sides to be rotated upward to form around the item or gift stored within the box. Removal of the lid allows the sides to drop away from the stored item that rests on the bottom of the box.

20 Claims, 12 Drawing Sheets

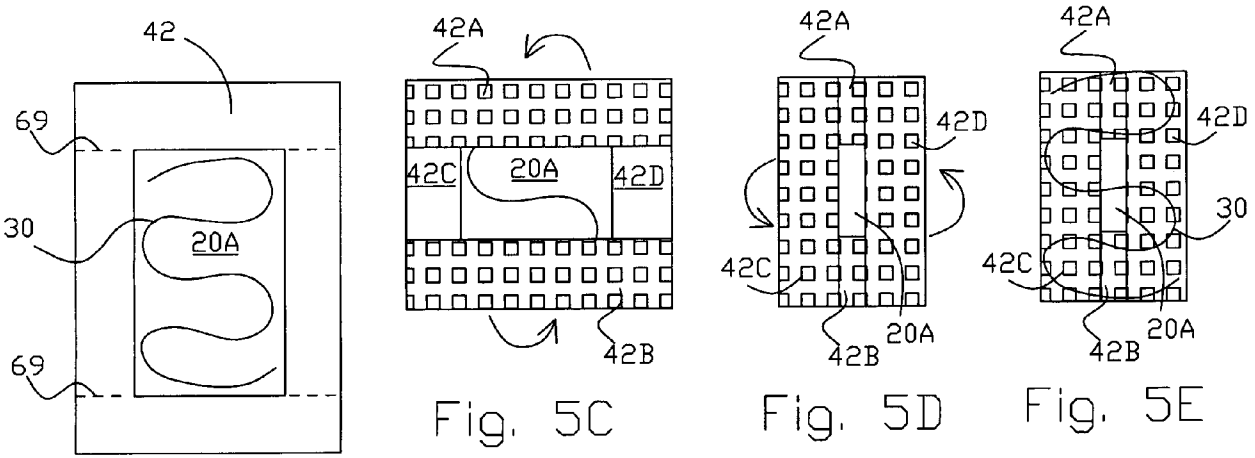
Fig. 5B
Fig. 5C
Fig. 5D
Fig. 5E
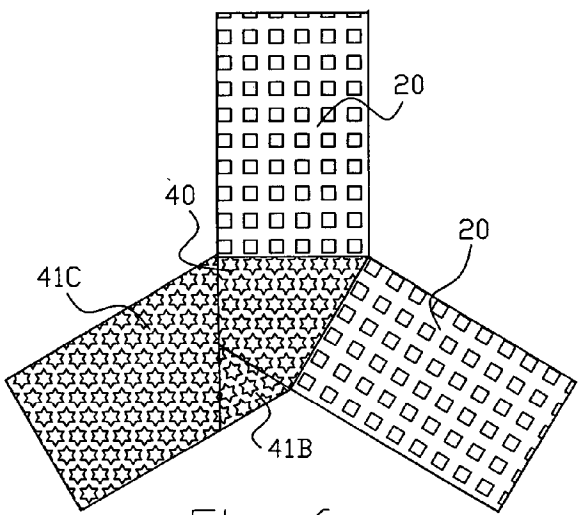
Fig. 6
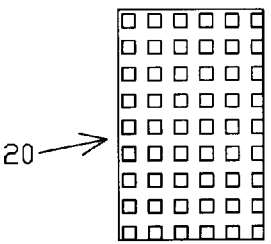
Fig. 5F

GIFT BOX HAVING DROP DOWN SIDES

There are no related patent applications.

The subject matter of the present invention did not receive federal government research and development funding.

BACKGROUND OF THE INVENTION

The present invention generally relates to a gift box for wrapping and securing gifts. More particularly, the invention relates to a gift box that has drop down sides that are released by the removal of a box lid. The lid is designed to receive an upper edge of each sidewall to hold them in place to define an area in which at least one item may be stored, presented, or delivered. Thus, the sidewalls create a solid box for delivering gifts, items and the like. Upon removal of the lid, each sidewall falls away from the defined area.

Known types of boxes include those having four sidewalls each including flaps at either ends. The flaps are folded over and secured to create a top and bottom. Some other types of boxes include tops that are removable. These boxes are designed such that the side walls are fixed relative to one another.

The box of the present invention comprises a shape forming element that acts as a support structure for the sidewalls and bottom. Typically, the support structure comprises cardboard which is scored between the sidewalls and the bottom to allow the sidewalls to be easily rotated upward relative to the bottom. An outer covering is secured to an exterior of the support structure to overlap the interior edges of the sidewalls. Decorative elements are formed or provided on an interior side of the bottoms and sidewalls. These decorative elements may be adhered to the sides and bottom of the support structure.

In a first step of manufacturing the box, the aforementioned box support structure is provided. Next, a circular piece of cloth is centered on and adhered to an inner bottom of the box via adhesive. The support structure, including the bottom and sidewalls, is deposited onto a circular piece of cloth having a diameter larger than the largest distance between any points on the sides. This piece of cloth acts as a decorative exterior to the box and is folded over the sidewalls and secured to interior edges of the support member. In the first embodiment, three cuts are made in the exterior piece of cloth. Adhesive is spread onto the inner side of the elements of the support structure and the exterior cloth is folded over each sidewall and secured thereto.

Additional inner panels are created by wrapping an additional piece of rectangular shaped support structure with a piece of cloth. A completed inner panel is adhered to the inside of each sidewall via adhesive or the like.

The lid of the box is formed by folding the sides from a lid support member to create a lid having a top formed in the same shape as the bottom of the box, but slightly larger in size of surface area to accommodate the thickness of each sidewall. Short sidewalls are provided on the lid to overlap the sidewalls of the box causing the sides to be held in place until the lid is removed.

The lid is preferably wrapped in a cloth or fabric and may further include batting disposed between the cloth and the lid support member to create a more decorative effect. An additionally inner panel having decorative markings thereon may also be provided and secured to an interior of the lid.

Securing means may be provided along the interior of each sidewall for securing items thereto. The securing means may include an elastic band or a pocket formed from fabric or other such material. Edges of the band or pocket forming material may be secured between an inner edge of the shape forming member and the inner panel.

SUMMARY OF THE INVENTION

The present invention is a box and a method of manufacturing it. The box is especially useful for delivery of a plurality of gifts that are either deposited within the confines of the box defined by sidewalls that drop down when a top is removed. At least one gift securing means may be arranged along each sidewall to secure smaller gifts that may relate to the item that rests on the bottom of the box.

The box may be formed in a variety of shapes and sizes. In a first embodiment, the box comprises a triangularly shaped bottom connected to three sides. The sides are integrally formed with and connect to the bottom via a scored section that operates as a hinge. The sides are then stood up to create a three-sided box. A lid rests atop the sides to hold them in place. Once the lid is removed, the sides fall outward and away to reveal the item stored therein.

In additional embodiments, the box may be formed with a square or rectangular shaped bottom along with four sides. Otherwise, the bottom may be of any geometric shape and a corresponding number of sides provided. The bottom may also include an arcuate shape so long as the sidewalls coupled to the bottom comprise an area that may be overlapped by the sidewalls of the lid.

It is an object of the invention to provide a box for having a bottom and hinged sidewalls. The sidewalls are secured in an upright position by first raising them and then depositing a lid atop them.

It is another object of the invention to provide a box having collapsible sides that fall away from one another when a lid is removed to reveal an inner area defined by the sides and wherein a gift may be stored and presented.

It is another object of the invention to provide an article of manufacture produced by providing a support member that is cut and scored to prepare a box as shown and described herein.

It is a further object of the invention to provide a gift box that includes sidewalls that define an inner area into which a gift may be deposited. The gift is exposed upon removal of a lid and the collapsing of the sidewalls away from the gift. Other related and smaller gifts may be secured onto the sidewalls to provide a gift box for delivering a plurality of gifts some of which are secured against the sidewalls.

These and other objects of the invention and advantages of the invention will be set forth, appear in part or become apparent after considering the specification and accompanying drawings. It is to be realized that the following embodiments of the invention have been represented in their simplest form for ease in understanding the invention.

BRIEF DESCRIPTION OF THE DRAWINGS

FIGS. 5A through 5F are plan views showing the steps in manufacturing the inner side of the walls. A rectangular strip of support material is deposited onto a strip of fabric or decorative material. Adhesive is provided on an opposite side of the support material. Edges of the decorative material are folded over the support material and secured thereto via the adhesive to form an inner sidewall. Another layer or strip of adhesive is provided between the sidewalls and the inner sidewalls.

FIG. 6 shows two inner side panels of the walls adhering to the support structure that forms the box. The third inner side panel has yet to be adhered to the third sidewall.

DETAILED DESCRIPTION OF THE INVENTION

The following is the preferred embodiment or best mode for carrying out the invention. It should be noted that this invention is not limited by the discussion of the preferred embodiment and should only be defined by the appended claims.

Figure 1:
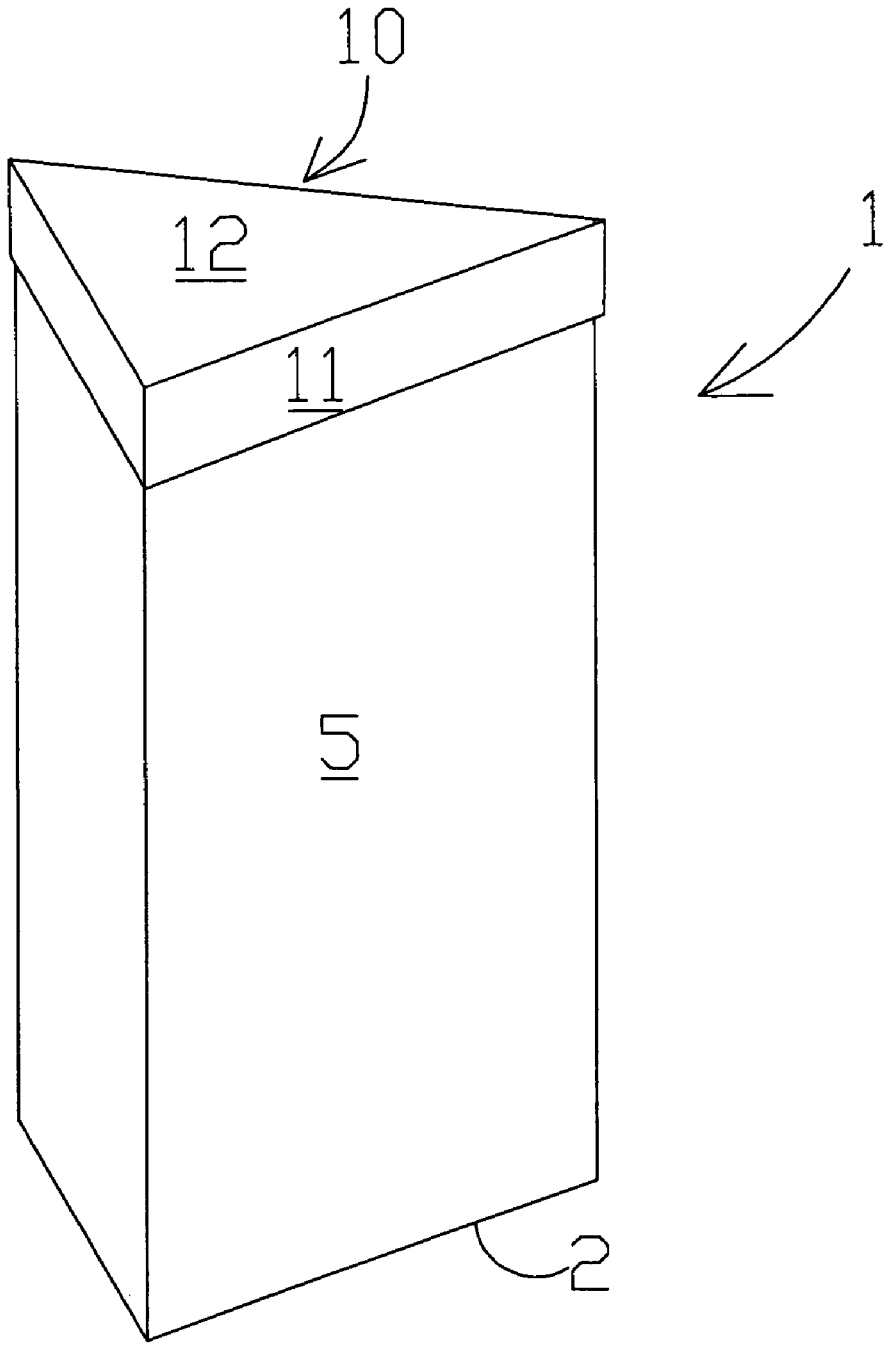
FIG. 1 is a perspective view of a first embodiment of the present invention. The box includes 3 sidewalls and a bottom that is triangular in shape. A lid includes short sidewalls and a top that is triangular in shape and having a slightly larger area than that of the bottom.
Figure 8A:
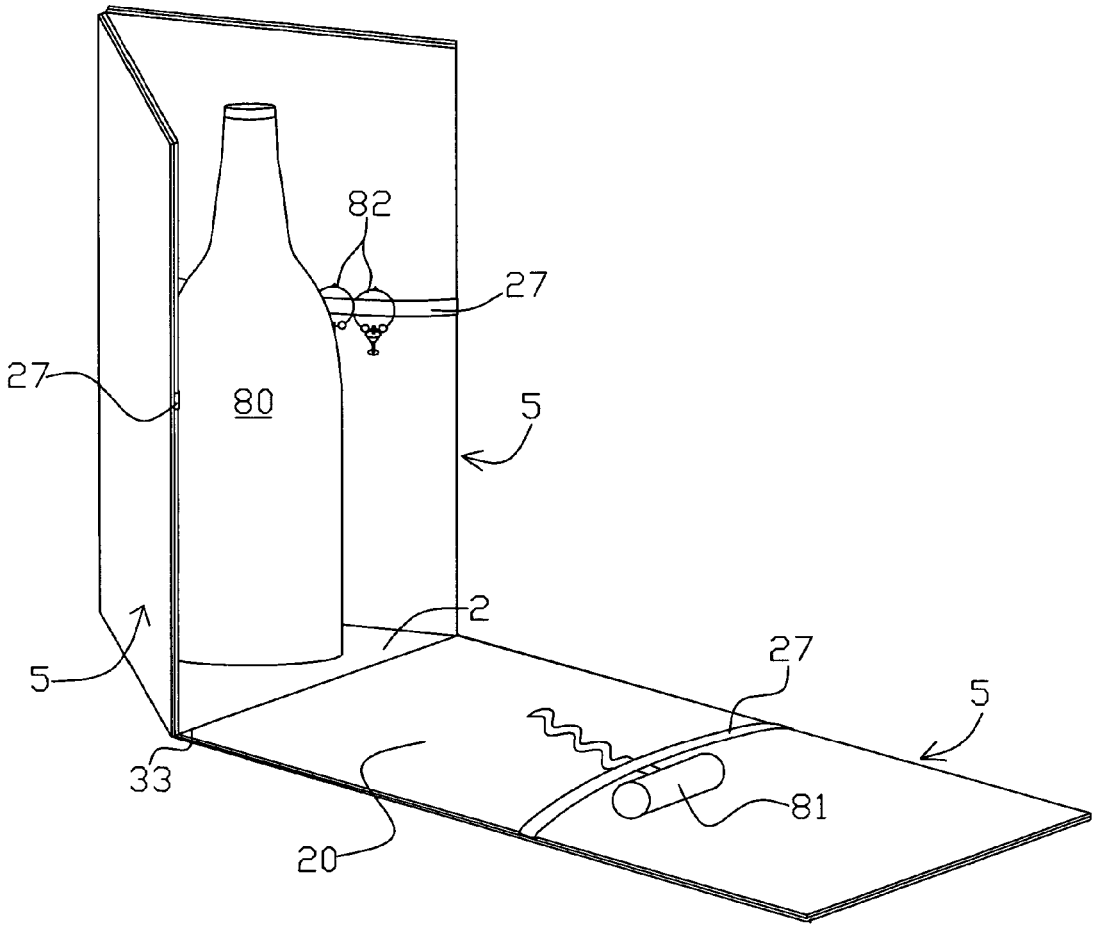
FIGS. 8A and 8B show the first embodiment with the top removed and one of the sides dropped down to reveal the inner area defined by the sides of the box.
Figure 8B:
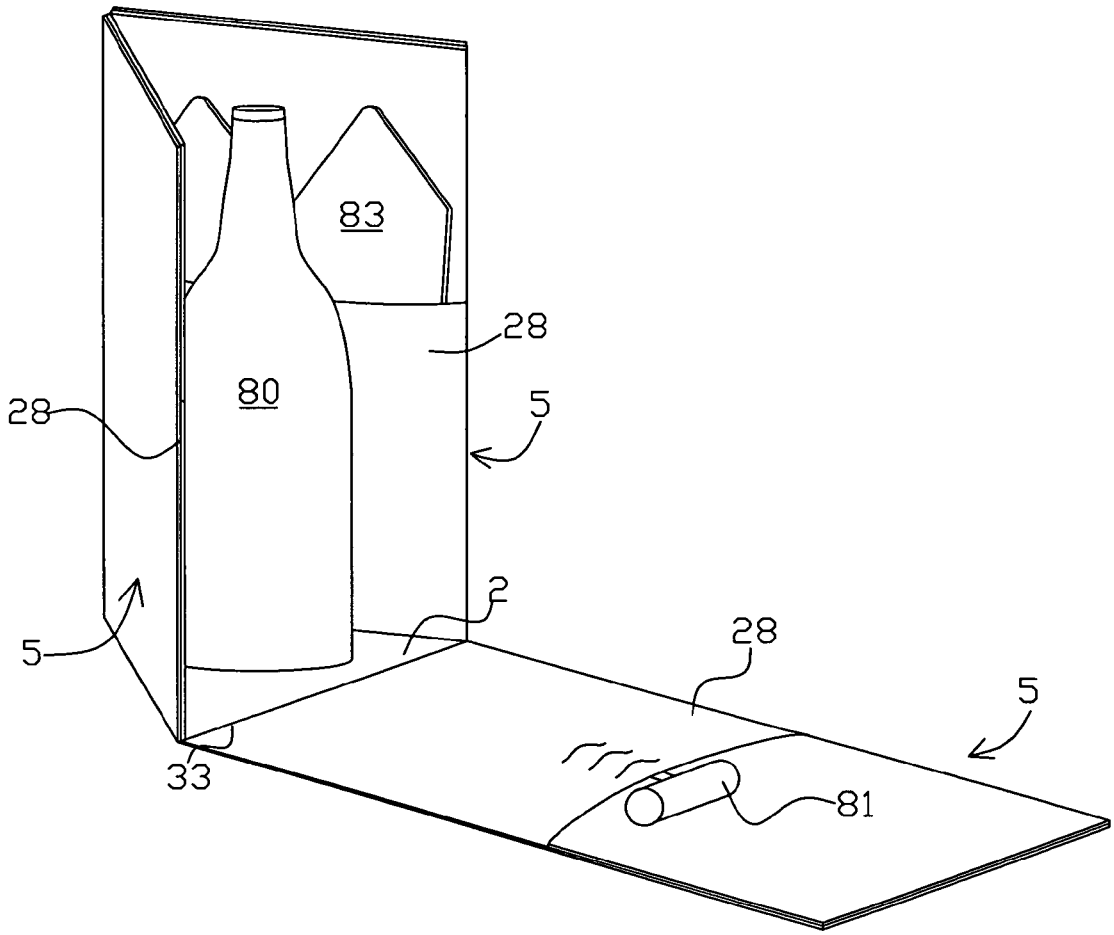

FIG. 1 is a perspective view of a box 1 having drop down sides 5 in the first embodiment. The box 1 comprises three sides 5 as shown in FIGS. 8A and 8B. A lid 10 includes a top 12 and lid sides 11 that overlap an upper edge of sides 5. The total surface area of top 12 is slightly larger than bottom 2. That is, the total surface area of top 12 equals or is greater than the total surface area of bottom 2 added to a thickness for each sidewall 5.

In FIGS. 8A and 8B, the lid 10 is removed. Each sidewall 5 comprises a strap 27 or pocket 28 for securing items against the respective sidewall 5. In FIG. 8A, a bottle of wine 80 is arranged on bottom 2. A sidewall 5 comprising an elastic band 27 secures a cork screw 81 against an inner panel 20 that is in turn secured to sidewall 5 which is shown as being dropped downward. Identification charms 82 are secured against a second inner panel 20 coupled to another sidewall 5 via a second band 27. Each sidewall 5 attaches to bottom 2 via a scored area that acts as a hinge 33. In FIG. 8B, each sidewall 5 may be provided with a pocket 28 created by overlapping a strip of material or cloth around the inner sidewall 20.

Figure 2C:
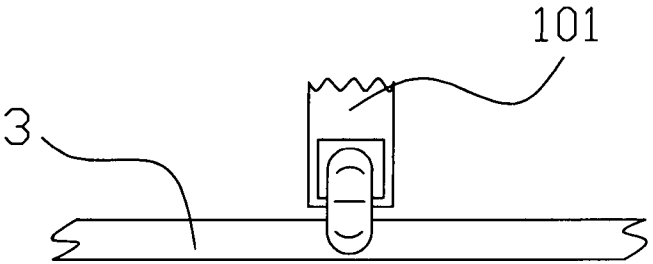
FIG. 2C depicts a preferred method of creating a hinge element that includes a hardened wheel that rolls across the shape forming material to create a hinge element about which the sidewall may be raised relative to the bottom of the box.
Figure 2B:
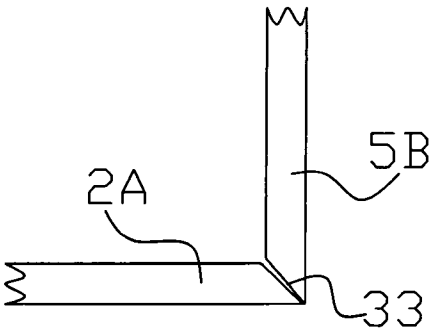
FIG. 2B depicts a partial elevation view taken while the sidewall is raised relative to the bottom.
Figure 2A:
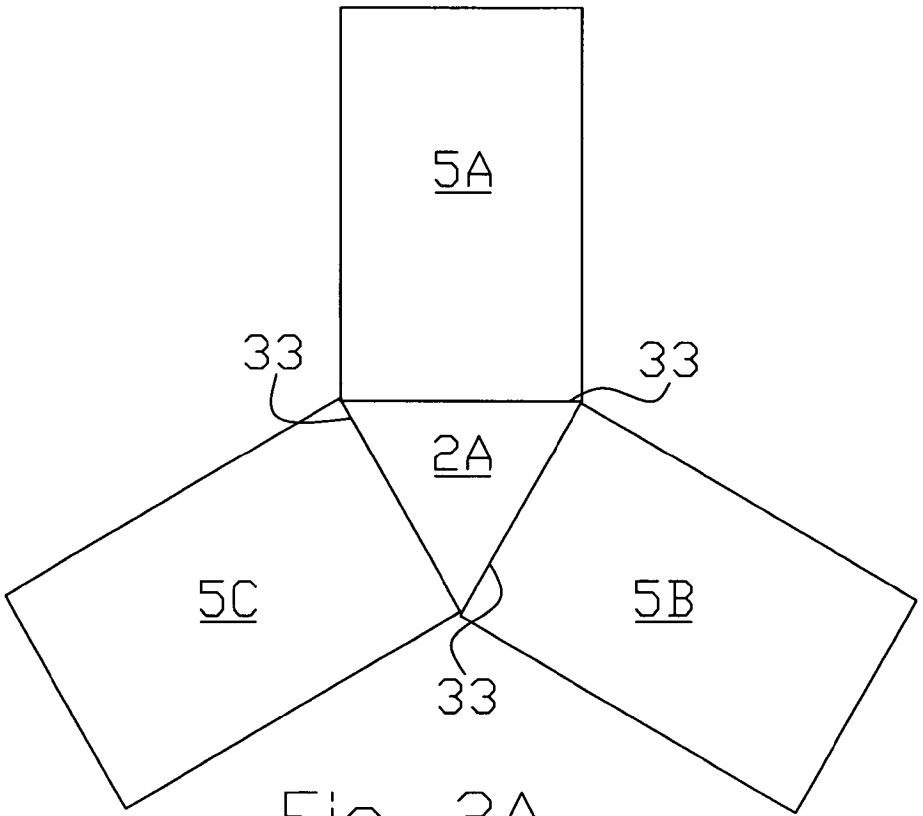
FIG. 2A is a plan view of the support members of the first embodiment shown in FIG. 1. The support structure for the box of the first embodiment comprises three sidewalls and a triangular shaped bottom connected together via scored areas that act as hinges.

FIG. 2A depicts the support panels for creating the box 1 that are overlapped with material to create the box 1. Box 1 includes a bottom support member 2A and three sidewall support members 5A-C. Hinge element 33 may be created by first providing a support member of cardboard. A steel wheel 101 or other hardened device may be rolled across the support member 3 to create a scored area wherein the cardboard is crushed to create a region having a thickness that is thinner than either the sidewall 5A-C or bottom 2A, as shown in FIG. 2C. This thinner area 33 operates as a hinge allowing the sidewall support members 5A-C to be rotated upward. As can be seen in FIG. 2B, the scored area 33 allows the sidewalls 5B to be brought up relative to the bottom 2A.

Figure 3A:
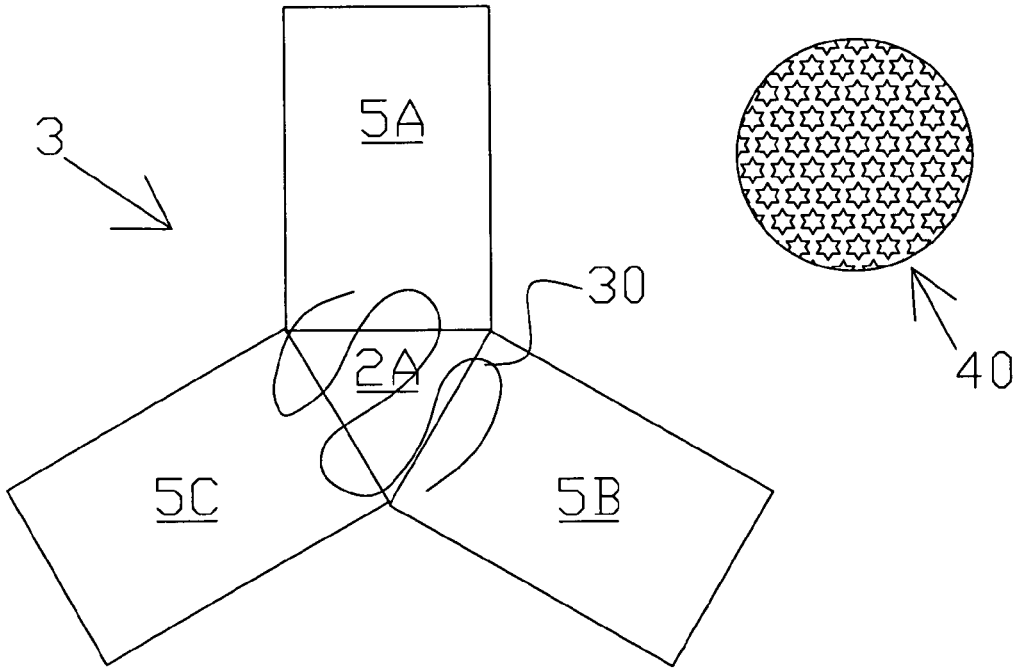
FIGS. 3A and 3B are plan views showing the first steps in manufacturing the first embodiment shown in FIG. 1. This includes the support structure and a circular strip of material that adheres to the bottom of the box.
Figure 3B:
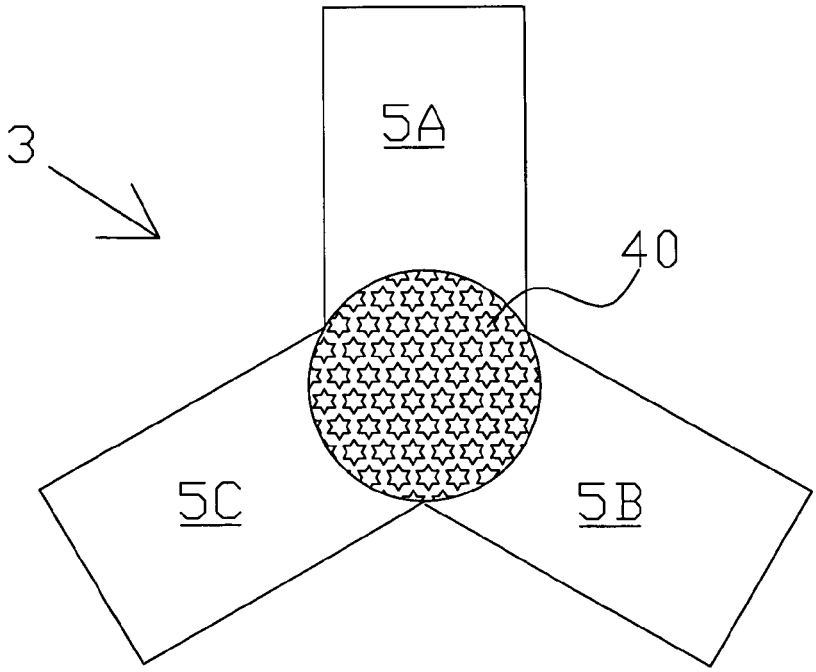

FIGS. 3A and 3B show the next step in manufacturing the box 1. Adhesive 30 is deposited onto support member 3 along with a circular decorative patterned material 40 to produce the assembly shown in FIG. 3B. Preferably, the decorative material 40 overlaps the area of the hinge 33 to provide additional support to the hinge 33. This decorative material 40 strengthens the hinge area.

Figure 4A:
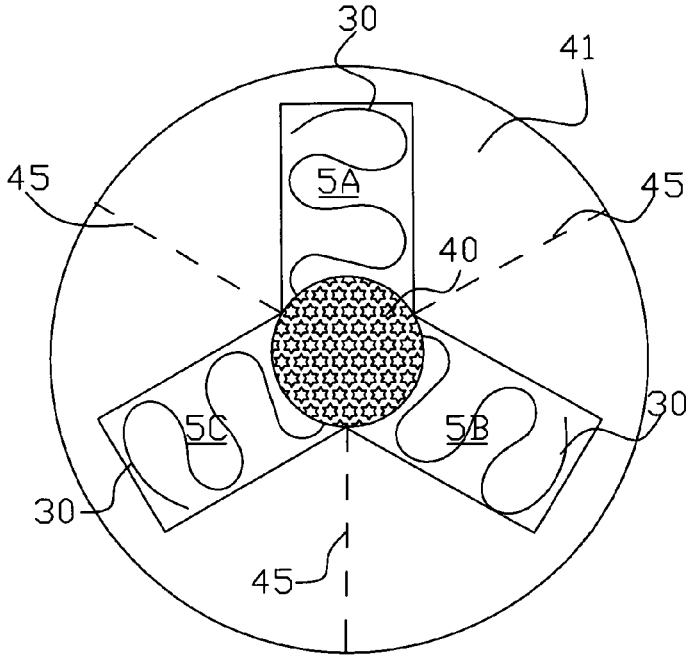
FIGS. 4A through 4C are plan view showing further steps in manufacturing the first embodiment shown in FIG. 1. Adhesive is deposited onto an inner side of the support structure. Edges of a cloth covering are folded around the support structure and secured thereto to cover each sidewall.
Figure 4B:
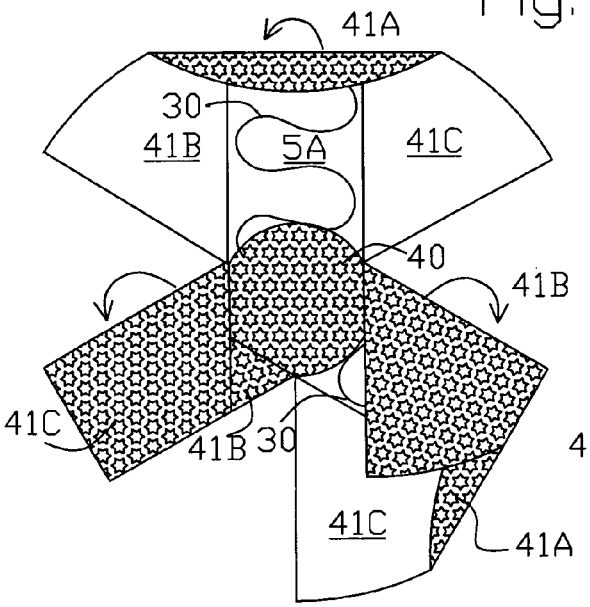
Figure 4C:
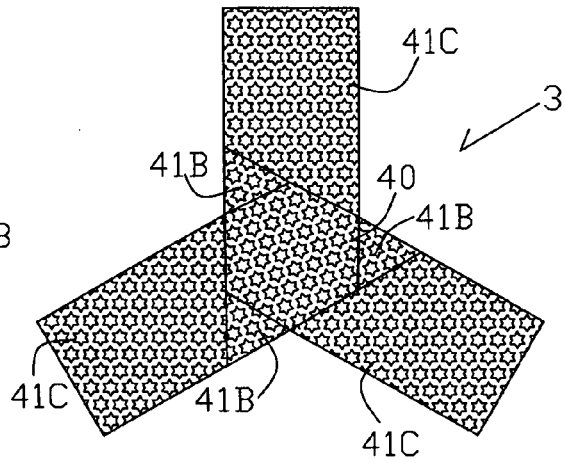

FIGS. 4A through 4C show the next steps in producing the box. The assembly from FIG. 3 is coated on one side with adhesive 30 and placed onto a cloth 41. Cuts, represented by broken lines 45, are made from an exterior edge of the cloth 41 towards the center of cloth 41. Next exterior edge 41A is folded over an upper edge of the support member sidewall 5A, as shown in FIG. 4B. Panels 41B are folded over support elements 5A before folding panel 41C over onto panel 41B. Each successive layer may include adhesive. A covered support member 3 is shown in FIG. 4C.

Figure 5A:
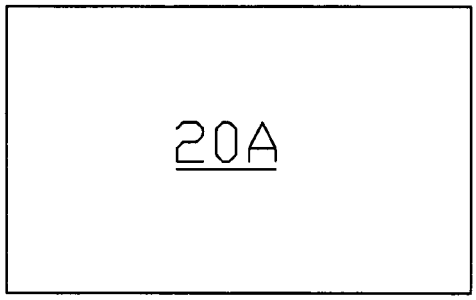

Now turning to FIGS. 5A through 5F, decorative support element 20A is provided atop decorative material or cloth 42. Opposite edges 42A and 42B are folded over as indicated at broken lines 69. Next, edges 42C and 42D are folded over onto edges 42A and 42B, as shown in FIG. 5D. Adhesive 30 is deposited on the overlapping edges as shown in FIG. 5E, an opposite of side of which is shown in FIG. 5F. The element 20 is then wrapped with an additional strip of cloth to create a pocket as shown in FIG. 8B. Otherwise, a strip of preferably elastic material 27 is wrapped around the support element 20 and sandwiched between the sidewalls 5 and support element 20.

FIG. 6 depicts a box that includes two of the decorative members 20. The third sidewall 5 is shown without the decorative member.

Figure 7D:
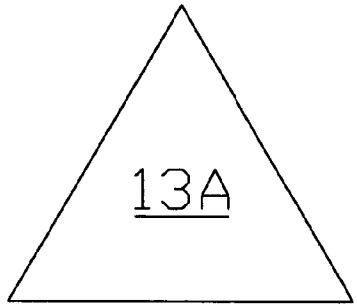
FIG. 7D is a plan view of an inner decorative liner of the lid.
Figure 7A:
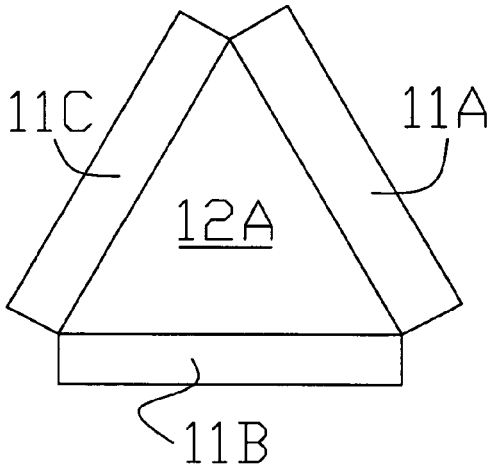
FIG. 7A denotes the shape forming element of the lid.
Figure 7C:
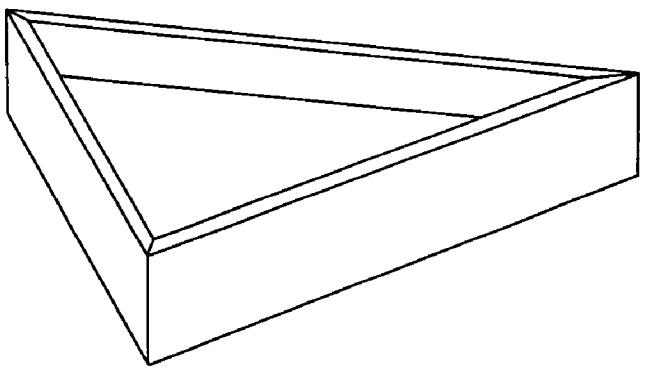
FIGS. 7B and 7C are perspective views of the top and bottom of the lid for the box, respectively.
Figure 7B:
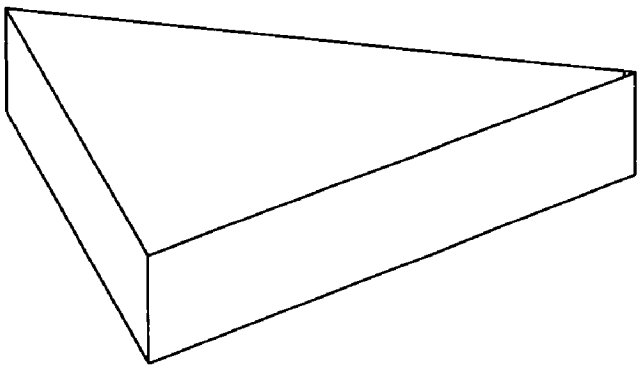

FIGS. 7A through 7E depict the lid assembly 12. FIG. 7A shows the top 12A and 11A through 11C that form the lid 12. The surface area of top 12 is greater than that of bottom 2. FIG. 7B shows an assembled support member from above; while FIG. 7C shows the lid from below. FIG. 7D is a decorative member 13A that is adhered to an inside of a box lid 12.

Figure 7E:
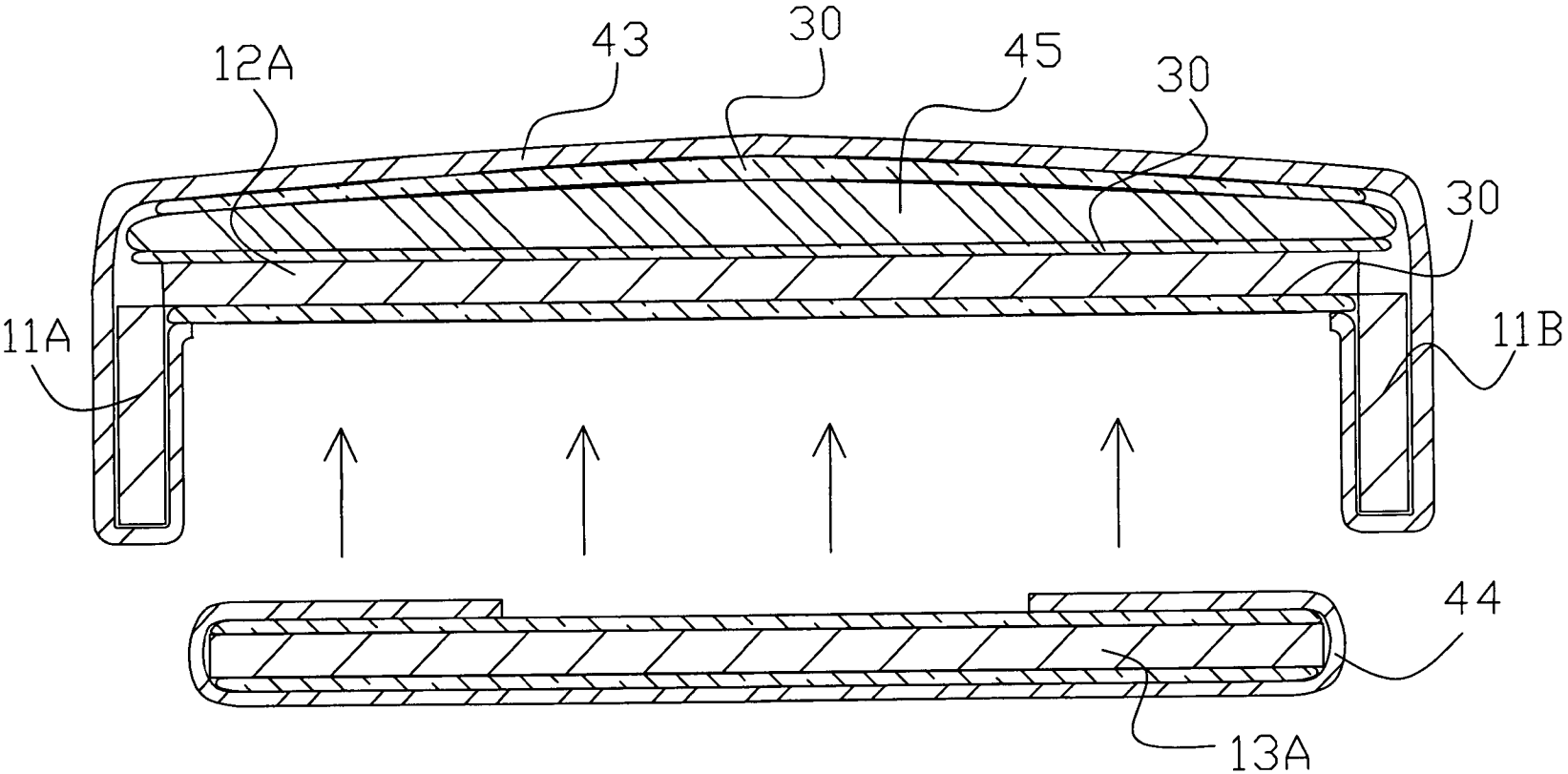
FIG. 7E is a cross sectional view of lid assembly. The lid includes a top and three short sidewalls that overlap the sidewalls of the box to secure them in place. An additional triangular shaped element may be added to the inside of the lid and the inside of the bottom.

In FIG. 7E, a support member 12A is provided along with lid sidewalls 11. A layer of adhesive 30 is deposited onto support member 12A. A layer of batting 45 is deposited onto adhesive 30. A second layer of adhesive 30 is deposited atop batting 45. Fabric or decorative material 43 is wrapped around batting 45 and sidewalls 11 to be secured against an inside edge of top 12A via adhesive 30. An inner decorative support member 13A is then inserted into the lid assembly and fastened there via adhesive 30.

Figure 9:
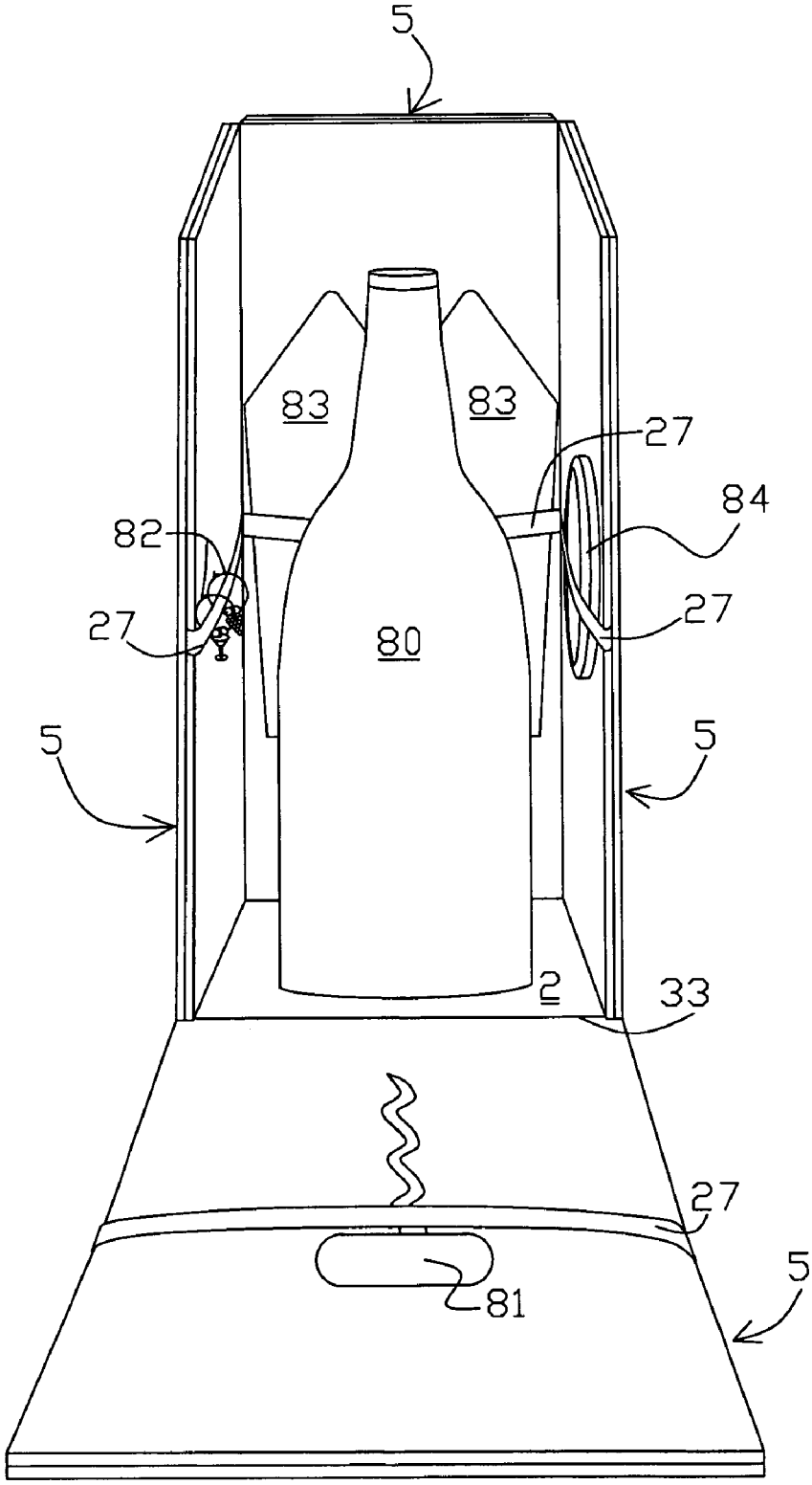
FIG. 9 is a perspective view of a second embodiment of the invention. In this embodiment, the box is formed from a shape forming element comprising a rectangular bottom and four sides.
Figure 10:
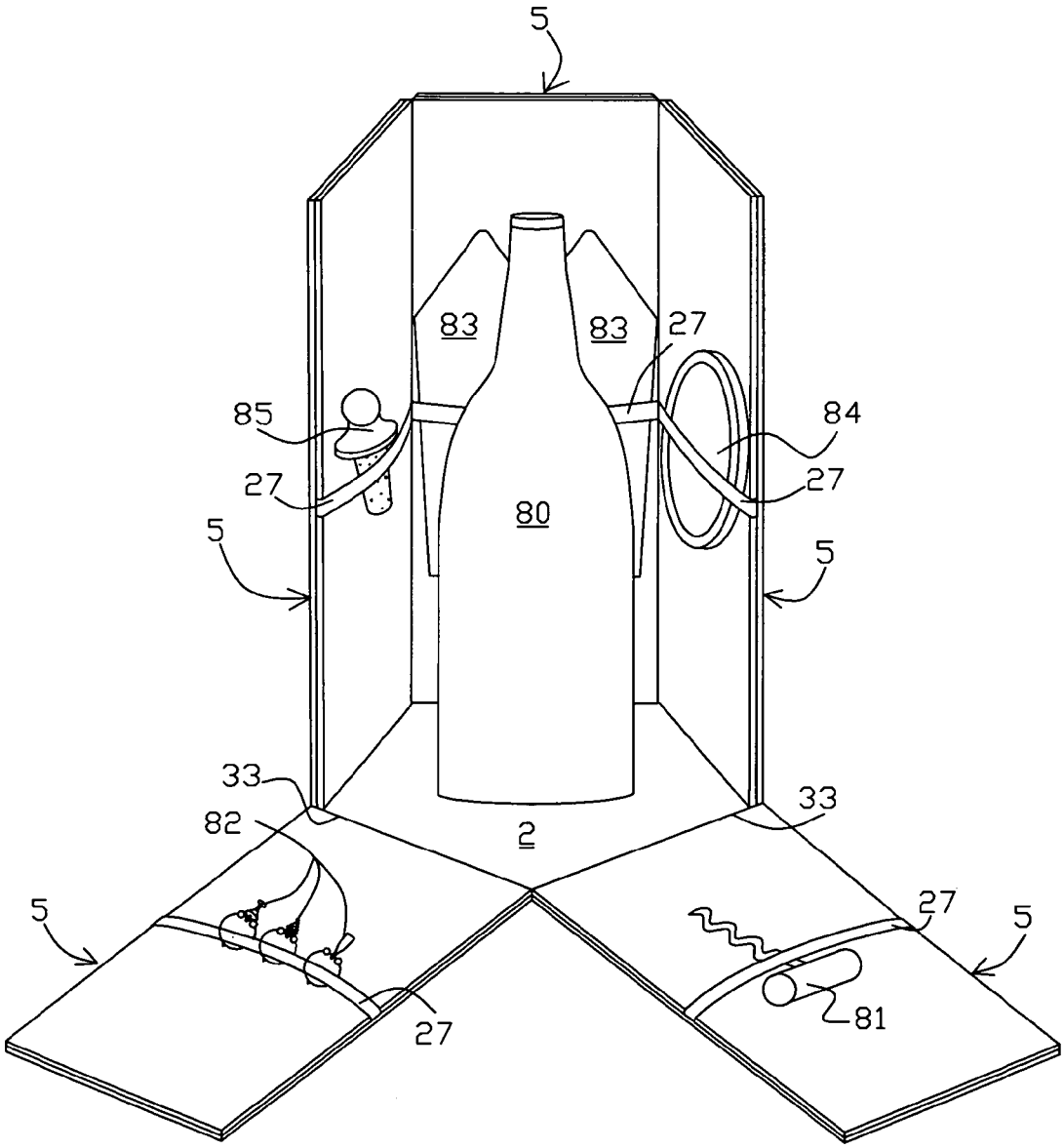
FIG. 10 is a perspective view of a third embodiment of the invention. In this embodiment the box comprises five sides and a pentagon shaped bottom.

FIGS. 9 and 10 show a box of the present invention that comprises four and five sides respectively. In FIG. 9, coaster 84 and napkins 83 are provided and secured to respective sides 5. A replacement cork 85 is provided and shown in FIG. 10. All of these embodiments are created in essentially the same method as described above with the exception that the shape of the box and lid support elements are different. However, it is to be understood that various modifications may be undertake to realize a box of different shapes and sizes.

It is also to be understood that the invention is not limited to the exact construction illustrated and described above. Various changes and modifications may be made without departing from the spirit and the scope of the invention as defined in the following claims.

I claim:

1. A gift box having collapsible sides that define an area for storing an item, said sides being secured in an upright position by a lid such that the sides fall away from the area for storing an item when the lid is removed, said box comprising:

a box support member that includes both a plurality of sidewalls and a bottom affixed to each sidewall, via a hinge member, each said hinge member allowing a respective said sidewall to rotate relative to the bottom, said box support member having an exterior, and the bottom and each sidewall of the box support member including an inner surface;

an exterior decorative material arranged against the exterior of the box support member and being cut to create an exterior edge, a first panel and a second panel for each said said sidewall, said exterior edge folded over an upper edge of a respective said sidewall, the first panel being adhered to the inner surface of a respective said sidewall, the second panel adhered to the first panel;

inner decorative material deposited onto the second panel of each respective said sidewall; and the lid comprising a top and lid sidewalls that overlap at least a portion of the exterior decorative material arranged against the sidewalls of the box support member; and securing means provided along the inner decorative material of each said box support member sidewall, said securing means holding a gift that is smaller than the item.

2. The box of claim 1 further including batting adhered between an exterior edge of the lid support member and a decorative covering that overlaps the lid.

3. The box of claim 1 further including a top insert adhered to an interior edge of the lid.

4. The box of claim 1 wherein said box comprises three sides, and wherein said lid and bottom are triangular in shape.

5. The box of claim 1 wherein said securing means includes an elastic band fastened to the inner decorative material of each sidewall comprising the box support member.

6. The box of claim 1 wherein said securing means is a pocket adhered to the inner decorative material fastened deposited onto the second panel of each respective box support member sidewall.

7. The box of claim 1 wherein said box support member comprises four sidewalls and a bottom, and wherein said lid and bottom are rectangular in shape.

8. The box of claim 1 wherein said box support member comprises five sidewalls and a bottom, and wherein said lid and bottom are pentagon in shape.

9. The box of claim 1 wherein said lid further comprises batting arranged on an exterior edge thereof.

10. A method of manufacturing a gift box that comprises collapsible sides, said collapsible sides being retained in place by a lid to define an area wherein an item is retained, said collapsible sides dropping downward to review the item when the lid is removed, said method comprising:

providing a box support member that includes a plurality of sidewalls coupled to a bottom;

providing a decorative inner bottom;

adhering said decorative inner bottom to the box support member to cover an inner surface of the bottom;

providing an outer decorative covering with edges;

overlapping said edges onto an inner surface area of respective sidewalls and adhering the edges thereto;

creating a securing means on each inner surface area of respective each sidewall that holds a gift smaller than said item; and wherein the lid overlaps an upper edge of the sidewalls.

11. The method of manufacturing a box of claim 10 further including creating an inner decorated sidewall panel that is secured to one of the plurality of sidewalls.

12. The method of manufacturing a box of claim 10 further including creating an inner top decorative panel.

13. The method of manufacturing a box of claim 10 further including scoring an area between the bottom and each said sidewall of sidewalls to create a hinge about which a respective sidewall is rotated relative to the bottom.

14. The method of manufacturing a box of claim 10 further including cutting said outer decorative covering to create strips of material that overlap and are secured to an inner edge of each said sidewall.

15. The method of manufacturing a box of claim 10 further including providing batting for the lid, said batting being adhered to a surface of the lid and overlapped with a decorative covering.

16. The method of manufacturing a box of claim 10 further including adhering an outer decorative covering to the lid.

17. The method of manufacturing a box of claim 10 further including a step of providing said lid comprises providing a lid support member having a surface area that is greater than a surface area of the bottom, said lid support member having a plurality of sidewalls that are equal in number to the total number of sidewalls provided on the box support member.

18. A box having sides that drop down when a lid is removed to reveal an inner area where an item is stored, said box comprising:

box sidewalls forming the sides and a bottom affixed thereto via hinge members;

an exterior decorative material overlapping and being adhered to an inner surface of the box sidewalls;

a plurality of inner decorative material deposited onto an inner side of each box sidewall to overlay an area wherein the exterior decorative material is adhered, said plurality of inner decorative material including a securing means that holds gifts that are smaller than the item; and a lid comprising a top and lid sidewalls that overlap at least a portion of the box sidewalls.

19. The box of claim 18 further including batting adhered between an exterior edge of the lid and a decorative covering that overlaps the lid.

20. The box of claim 18 further including a top insert adhered to an interior edge of the lid.

* * * * *